US012577752B2

(12) United States Patent
Noda et al.

(10) Patent No.: US 12,577,752 B2
(45) Date of Patent: Mar. 17, 2026

(54) WORK MACHINE

(71) Applicant: KOBELCO CONSTRUCTION MACHINERY CO., LTD., Hiroshima (JP)

(72) Inventors: Daisuke Noda, Hiroshima (JP); Nobuhiro Fukuo, Hiroshima (JP); Masaki Akiyama, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 203 days.

(21) Appl. No.: 18/553,780

(22) PCT Filed: Mar. 8, 2022

(86) PCT No.: PCT/JP2022/009850
§ 371 (c)(1),
(2) Date: Oct. 3, 2023

(87) PCT Pub. No.: WO2022/215413
PCT Pub. Date: Oct. 13, 2022

(65) Prior Publication Data

US 2024/0183123 A1 Jun. 6, 2024

(30) Foreign Application Priority Data

Apr. 6, 2021 (JP) ..... 2021-064743

(51) Int. Cl.
*E02F 3/43* (2006.01)
*E02F 3/32* (2006.01)

(52) U.S. Cl.
CPC ..... *E02F 3/439* (2013.01); *E02F 3/437* (2013.01); *E02F 3/32* (2013.01)

(58) Field of Classification Search
CPC ..... E02F 3/439; E02F 3/437; E02F 3/32
See application file for complete search history.

(56) References Cited

U.S. PATENT DOCUMENTS 4,753,568 A 6/1988 Langenfeld et al.
2018/0171582 A1 6/2018 Yamada et al.
(Continued)

FOREIGN PATENT DOCUMENTS

EP 3 779 070 A1 2/2021
JP 55-119838 A 9/1980
(Continued)

OTHER PUBLICATIONS https://youtu.be/LHIHmM0siYA?si=7cT_ffM-8rCWm0Zr, Baxter robot using a wrench to turn a valve, 2016 (Year: 2016).*
(Continued)

*Primary Examiner* — Navid Z. Mehdizadeh
*Assistant Examiner* — Oliver Tan
(74) *Attorney, Agent, or Firm* — Oblon, McClelland, Maier & Neustadt, L.L.P.

(57) ABSTRACT

Provided is a work machine capable of loading a transport object at a fixed point of a loading target. A controller is included that automatically performs an operation of discharging soil and sand held by a bucket (33) by driving a boom (31), an arm (32), and the bucket (33) based on a target loading point (P) set above a loading bed (56). After the controller rotates the bucket (33) such that the opening surface of the bucket (33) becomes vertical at the target loading point (P), the controller drives the boom (31), the arm (32), and the bucket (33) such that the opening surface of the bucket (33) faces downward while maintaining the position (T), with respect to the machine body, of the leading end of the bucket (33) in a front-and-rear direction.

2 Claims, 5 Drawing Sheets

(56) References Cited

U.S. PATENT DOCUMENTS

| | | | | |
|---|---|---|---|---|
| 2018/0251956 | A1 | 9/2018 | Hoshaku et al. | |
| 2018/0305902 | A1 | 10/2018 | Tsukamoto | |
| 2021/0010237 | A1 | 1/2021 | Aizawa et al. | |
| 2021/0071384 | A1 | 3/2021 | Gurney | |
| 2022/0025616 | A1* | 1/2022 | Kean | E02F 9/2004 |
| 2022/0127817 | A1 | 4/2022 | Sano et al. | |
| 2023/0074375 | A1* | 3/2023 | Okuwaki | E02F 9/24 |

FOREIGN PATENT DOCUMENTS

| | | | |
|---|---|---|---|
| JP | 2-47432 | A | 2/1990 |
| JP | 6-19546 | A | 1/1994 |
| JP | 10-18339 | A | 1/1998 |
| JP | 2010-229663 | A | 10/2010 |
| JP | 2012-36645 | A | 2/2012 |
| JP | 2020-20155 | A | 2/2020 |
| JP | 2021-11694 | A | 2/2021 |
| JP | 2021-507142 | A | 2/2021 |
| WO | WO 2017/010212 | A1 | 1/2017 |
| WO | WO 2021/006349 | A1 | 1/2021 |

OTHER PUBLICATIONS https://youtu.be/YgViXauhBfU?si=0ubtPidGemKhG47T, Liebherr Excavator Loading Trucks, 2020 (Year: 2020).*

Extended European Search Report issued Jul. 24, 2024 in European Patent Application No. 22784398.4, 5 pages.

International Search Report issued May 24, 2022 in PCT/JP2022/009850 filed on Mar. 8, 2022, 3 pages.

Combined Chinese Office Action and Search Report issued Jun. 27, 2025, in corresponding Chinese Patent Application No. 202280019023.X (with English Translation of Category of Cited Documents), 13 pages.

* cited by examiner

WORK MACHINE

TECHNICAL FIELD

The present invention relates to a work machine that automatically performs an operation of discharging a transport object held by a bucket.

BACKGROUND ART

Patent Literature 1 discloses a system that automatically controls and causes a hydraulic excavator to discharge soil to a transporter vehicle stopped at a loading position. In Patent Literature 1, automatic soil discharge is executed while detecting a position of a loading bed of a transporter vehicle from an image captured by a camera.

However, when only the bucket is rotated at the time of discharging a transport object (such as soil and sand), there occurs a variation in the position where the transport object is loaded on a loading target (a loading bed of a transporter vehicle or the like). For example, in accordance with soil properties of the soil and sand, the soil and sand are discharged at an early stage of the rotational move, or the soil and sand are discharged at a late stage of the rotational move, so that the loading position of the soil and sand varies. Therefore, it is preferable that the transport object can be loaded at a fixed point of the loading target.

CITATION LIST

Patent Literature

Patent Literature 1: JP 2020-20155 A

SUMMARY OF INVENTION

An object of the present invention is to provide a work machine capable of loading a transport object at a fixed point of a loading target.

The present invention includes: a machine body; a boom attached to the machine body to be rotatable in an up-and-down direction; an arm attached to the boom to be rotatable in the up-and-down direction; a bucket attached to the arm to be rotatable in a front-and-rear direction; and a controller that causes the boom, the arm, and the bucket to automatically perform an operation of discharging a transport object held by the bucket by driving the boom, the arm, and the bucket, based on a target loading point set above a loading target, wherein after the controller causes the bucket to rotate such that an opening surface of the bucket becomes vertical at the target loading point, the controller drives the boom, the arm, and the bucket such that the opening surface of the bucket faces downward while maintaining a position, with respect to the machine body, of a leading end of the bucket in the front-and-rear direction.

According to the present invention, after the bucket is rotated such that the opening surface of the bucket becomes vertical at the target loading point, the boom, the arm, and the bucket are driven such that the opening surface of the bucket faces downward while the position, with respect to the machine body, of the leading end of the bucket in the front-and-rear direction is maintained. By causing the opening surface of the bucket to face downward while maintaining the position, with respect to the machine body, of the leading end of the bucket, the position where the transport object is discharged can be made substantially the same from the early stage to the late stage of the rotation of the bucket. As a result, the transport object can be loaded at the fixed point of the loading target.

DESCRIPTION OF EMBODIMENT

In the following, a preferred embodiment of the present invention will be described with reference to the drawings.

(Configuration of Work Machine)

Figure 1:
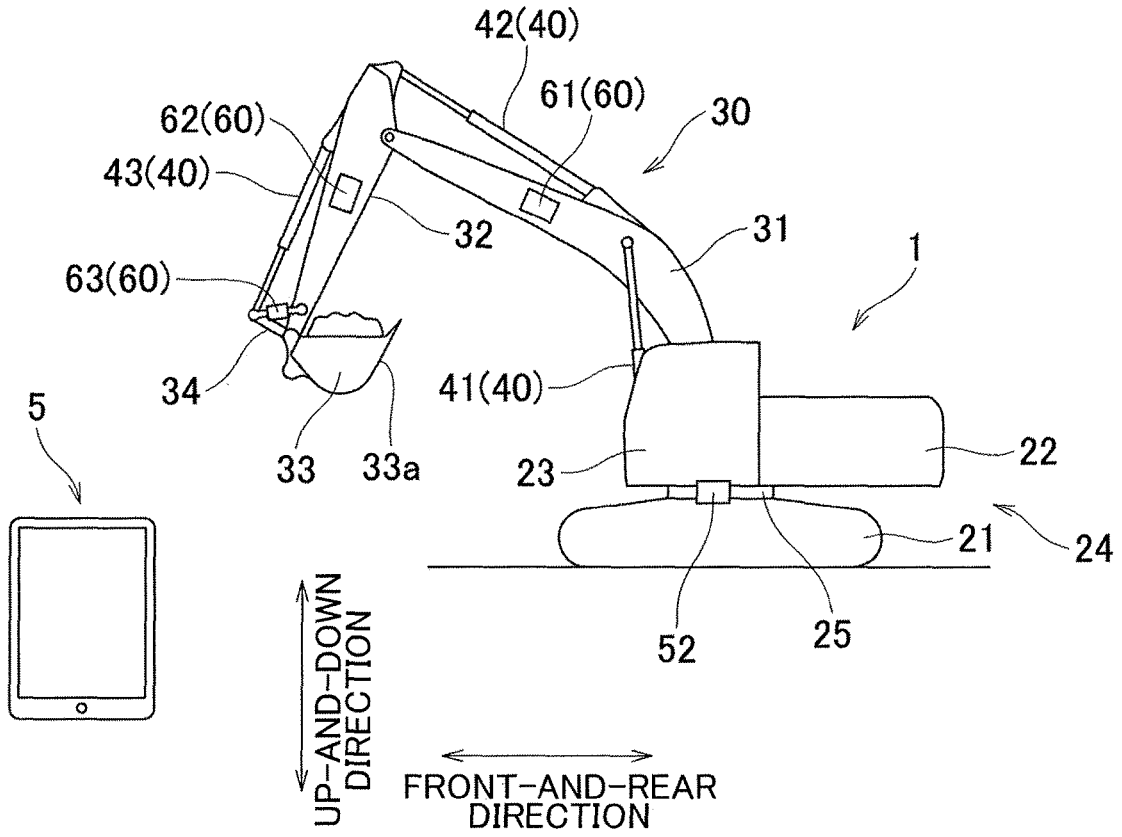
FIG. 1 is a side view of a work machine.

A work machine according to an embodiment of the present invention automatically performs an operation of discharging a transport object held by a bucket. As illustrated in FIG. 1, which is a side view of a work machine 1, the work machine 1 is a machine that performs work with an attachment 30, and is, for example, a hydraulic excavator. The work machine 1 has: a machine body 24 including a lower travelling body 21 and an upper slewing body 22; the attachment 30; and cylinders 40.

The lower travelling body 21 is a portion that causes the work machine 1 to travel, and includes, for example, a crawler. The upper slewing body 22 is slewably attached to an upper part of the lower travelling body 21 via a slewing device 25. A cab (driver's cabin) 23 is located at a front part of the upper slewing body 22.

The attachment 30 is attached to the upper slewing body 22 to be rotatable in an up-and-down direction. The attachment 30 includes a boom 31, an arm 32, and a bucket 33. The boom 31 is attached to the upper slewing body 22 to be rotatable in an up-and-down direction (capable of rising and contracting). The arm 32 is attached to the boom 31 to be rotatable in an up-and-down direction. The bucket 33 is attached to the arm 32 so as to be rotatable in a front-and-rear direction. The bucket 33 is a portion that performs work including excavation, leveling, and scooping of soil and sand (transport object). However, the transport object is not limited to soil and sand, and may be a stone or a waste (industrial waste or the like).

The cylinders 40 can hydraulically move the attachment 30 rotationally. The cylinders 40 are hydraulic telescopic cylinders. The cylinders 40 include a boom cylinder 41, an arm cylinder 42, and a bucket cylinder 43.

The boom cylinder 41 rotationally moves the boom 31 with respect to the upper slewing body 22. The boom cylinder 41 has a base end part rotatably attached to the upper slewing body 22. The boom cylinder 41 has a leading end part rotatably attached to the boom 31.

The arm cylinder 42 rotationally moves the arm 32 with respect to the boom 31. The arm cylinder 42 has a base end part rotatably attached to the boom 31. The arm cylinder 42 has a leading end part rotatably attached to the arm 32.

The bucket cylinder 43 rotationally moves the bucket 33 with respect to the arm 32. The bucket cylinder 43 has a base end part rotatably attached to the arm 32. The bucket cylinder 43 has a leading end part rotatably attached to a link member 34 rotatably attached to the bucket 33.

The work machine 1 further includes an angle sensor 52, and inclination angle sensors 60.

The angle sensor 52 detects a slewing angle of the upper slewing body 22 with respect to the lower travelling body 21. The angle sensor 52 is, for example, an encoder, a resolver, or a gyro sensor. In the present embodiment, the slewing angle of the upper slewing body 22 when a front side of the upper slewing body 22 coincides with a front side of the lower travelling body 21 is 0°.

The inclination angle sensors 60 detect an orientation of the attachment 30. The inclination angle sensors 60 includes a boom inclination angle sensor 61, an arm inclination angle sensor 62, and a bucket inclination angle sensor 63.

The boom inclination angle sensor 61 is attached to the boom 31 and detects an attitude of the boom 31. The boom inclination angle sensor 61 may be a sensor that acquires an inclination angle of the boom 31 with respect to the horizontal line, and may be, for example, an inclination (acceleration) sensor or the like. Note that the boom inclination angle sensor 61 may be a rotation angle sensor that detects a rotation angle of a boom foot pin (a base end of the boom) or a stroke sensor that detects a stroke amount of the boom cylinder 41.

The arm inclination angle sensor 62 is attached to the arm 32 to detect an orientation of the arm 32. The arm inclination angle sensor 62 may be a sensor that acquires an inclination angle of the arm 32 with respect to the horizontal line, and may be, for example, an inclination (acceleration) sensor or the like. Note that the arm inclination angle sensor 62 may be a rotation angle sensor that detects a rotation angle of an arm connection pin (a base end of the arm) or a stroke sensor that detects a stroke amount of the arm cylinder 42.

The bucket inclination angle sensor 63 is attached to the link member 34 to detect an orientation of the bucket 33. The bucket inclination angle sensor 63 may be a sensor that acquires an inclination angle of the bucket 33 with respect to the horizontal line, and may be, for example, an inclination (acceleration) sensor or the like. Note that the bucket inclination angle sensor 63 may be a rotation angle sensor that detects a rotation angle of a bucket connection pin (base end of the bucket) or a stroke sensor that detects a stroke amount of the bucket cylinder 43.

(Configuration of Transport Vehicle)

Figure 2:
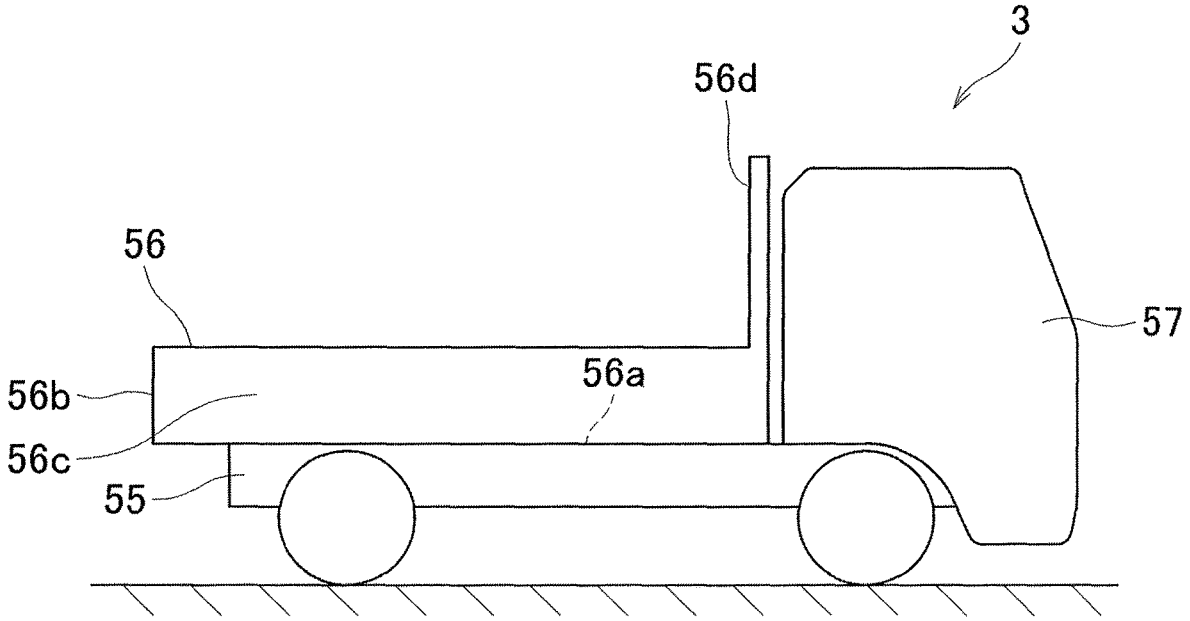
FIG. 2 is a side view of a transport vehicle.

As illustrated in FIG. 2, which is a side view of the transport vehicle 3, the transport vehicle 3 is a vehicle having a loading bed 56, which is the loading target. The transport vehicle 3 is a vehicle for transporting soil and sand (load) loaded by the work machine 1, and may be a dump truck or a truck.

The transport vehicle 3 includes a main body 55 and a loading bed 56. The main body 55 can travel and supports the loading bed 56. The main body 55 includes a driver's cabin 57. The loading bed 56 is disposed on the rear side of the transport vehicle 3 with respect to the driver's cabin 57.

Hereinafter, as for the directions related to the transport vehicle 3, the side from the driver's cabin 57 toward the loading bed 56 is referred to as a "transport vehicle rear side", and a side from the loading bed 56 toward the driver's cabin 57 is referred to as a "transport vehicle front side".

The loading bed 56 has no lid, and has, for example, a box shape. The loading bed 56 includes a floor surface 56*a*, a drop tailgate surface 56*b*, side drop panel surfaces 56*c* on the right and left sides, and a cab protector surface 56*d*. The floor surface 56*a* is a bottom surface (lower surface) of the loading bed 56. The drop tailgate surface 56*b* is a surface of the loading bed 56 on the transport vehicle rear side, and protrudes upward from a part of the floor surface 56*a* on the transport vehicle rear side. The side drop panel surfaces 56*c* are right and left surfaces of the loading bed 56, and protrude upward from right and left end parts of the floor surface 56*a*. The cab protector surface 56*d* is a surface of the loading bed 56 on the front side of the transport vehicle, and protrudes upward from a part of the floor surface 56*a* on the transport vehicle front side. The cab protector surface 56*d* protrudes higher than the side drop panel surfaces 56*c* and protrudes higher than the drop tailgate surface 56*b*.

The loading bed 56 stores soil and sand (load). The loading bed 56 may be movable with respect to the main body 55 or may be fixed to the main body 55. Note that the loading target on which the work machine 1 performs a loading work (soil discharging work) need not be the loading bed 56 of the transport vehicle 3, and may be, for example, a container directly placed on the ground or the like.

(Configuration of Mobile Terminal)

As shown in FIG. 1, a mobile terminal 5 is a terminal operated by a worker at a work site, and is, for example, a tablet terminal. The mobile terminal 5 is mutually communicable with the work machine 1. Note that the mobile terminal 5 may be a smartphone or the like.

(Circuit Configuration of Work Machine and Mobile Terminal)

Figure 3:
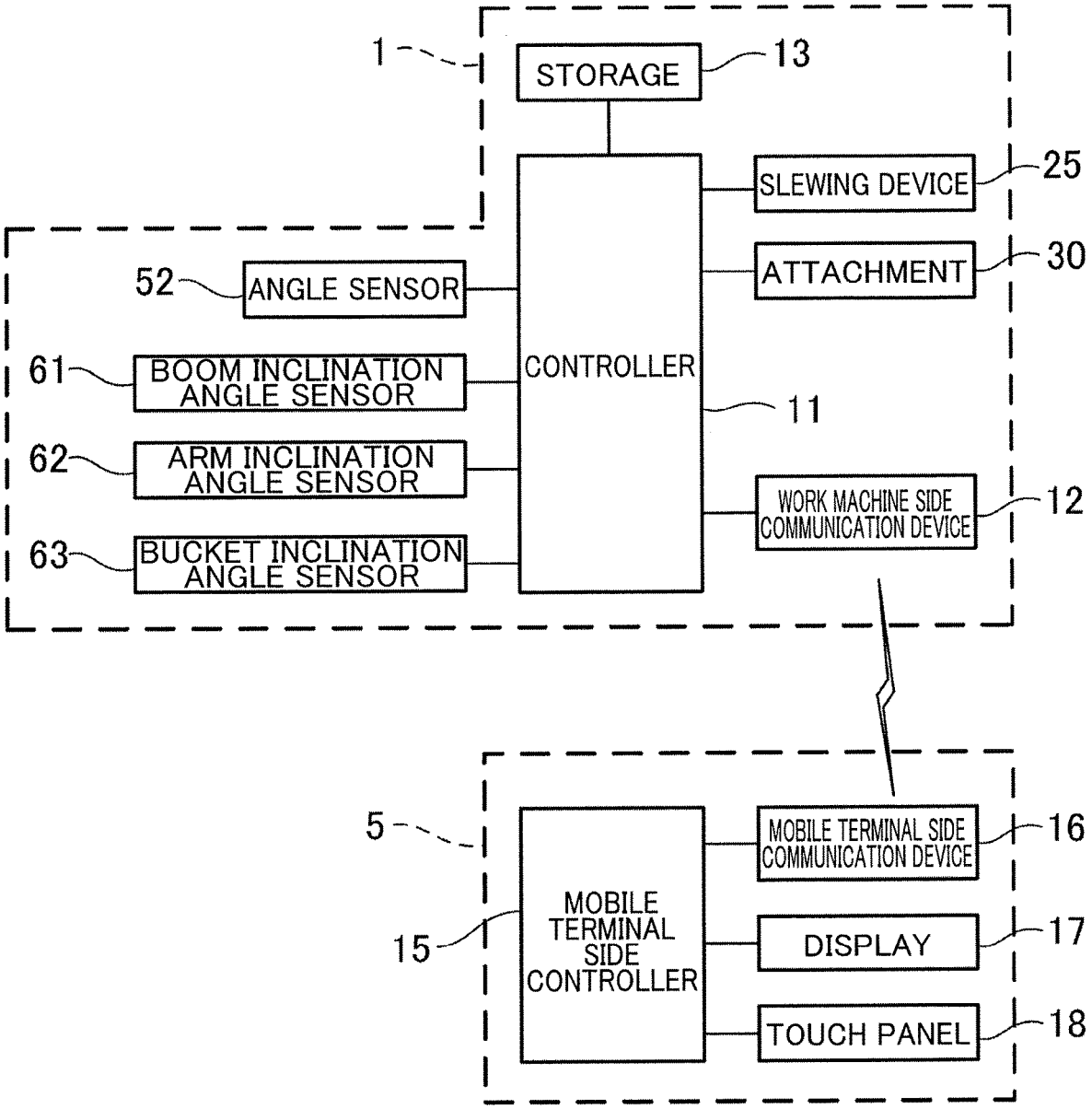
FIG. 3 is circuit diagrams of the work machine and a mobile terminal.

As shown in FIG. 3, which is circuit diagrams of the work machine 1 and the mobile terminal 5, the work machine 1 includes a controller 11, a work machine side communication device 12, and a storage 13.

The controller 11 automatically controls the work machine 1. The controller 11 causes the work machine 1 to automatically perform a series of operations from excavation of soil and sand to soil discharging. In other words, the work machine 1 is automatically operated. Specifically, the controller 11 automatically operates the slewing device 25 and the attachment 30 based on detection values by the angle sensor 52 and the inclination angle sensors 60.

The work machine side communication device 12 is communicable with a mobile terminal side communication device 16 to be described later of the mobile terminal 5. The storage 13 can store a target loading point to be described later.

The mobile terminal 5 includes a mobile terminal side controller 15, the mobile terminal side communication device 16, a display 17, and a touch panel 18.

The mobile terminal side communication device 16 can communicate with the work machine side communication device 12 of the work machine 1. The mobile terminal side controller 15 receives information on a position of the leading end of the arm 32 (a base end of the bucket 33) from the work machine 1 via the mobile terminal side communication device 16.

Figure 4:
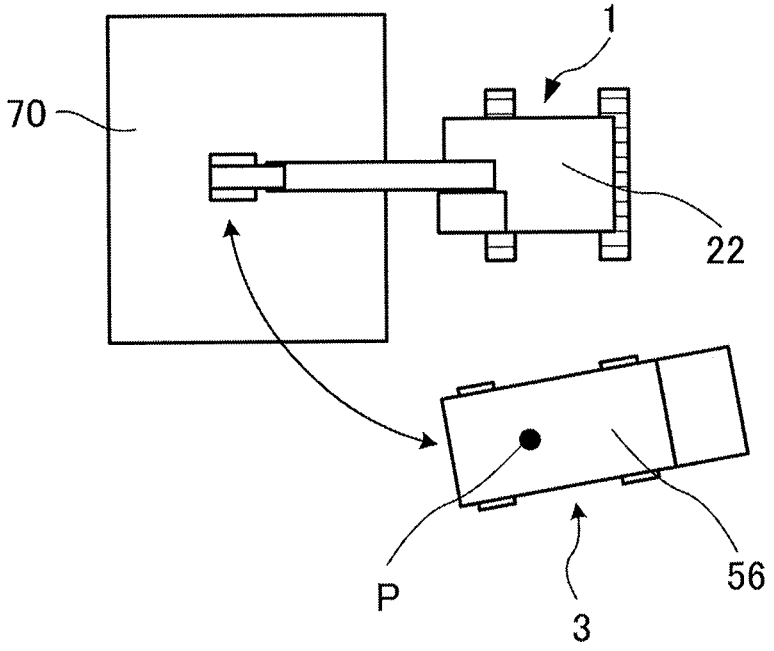
FIG. 4 is a top view of the work machine and the transport vehicle.

Here, as illustrated in FIG. 4, which is a top view of the work machine 1 and the transport vehicle 3, a series of operations from excavation of soil and sand to soil discharging is performed in a state where the transport vehicle 3 is disposed such that the longitudinal direction of the transport vehicle 3 is along the slewing direction of the upper slewing body 22 of the work machine 1 and the transport vehicle 3 is stopped. That is, after the bucket 33 scoops soil and sand from a soil-and-sand storage place 70, the controller 11 causes the upper slewing body 22 to slew so as to position the bucket 33 above the loading bed 56 of the transport vehicle 3. Then, after soil is discharged into the loading bed 56, the controller 11 causes the upper slewing body 22 to slew in the direction opposite to the above direction so as to position the bucket 33 above the soil-and-sand storage place 70. The controller 11 causes these operations to be automatically repeated. The soil-and-sand storage place 70 is a soil-and-sand pit or a soil-and-sand mound.

The controller 11 of the work machine 1 sets a target loading point P above the loading bed 56. The target loading point P is a target position at which the work machine 1 performs loading work (soil discharging work) on the transport vehicle 3. The loading work is work of discharging soil and sand held by the bucket 33 to the loading bed 56. The target loading point P is set by so-called teaching.

The teaching is performed as follows. First, the leading end of the arm 32 (the base end of the bucket 33) is disposed above the loading bed 56 by a manual operation by an operator. When the operator carrying the mobile terminal 5 checks the position of the leading end of the arm 32 at this time and determines that there is no problem, the operator operates the touch panel 18 to establish the position. Information on the position is transmitted to the controller 11 of the work machine 1, and the position of the leading end of the arm 32 at this time is set as the target loading point P and stored in the storage 13.

A plurality of target loading points P may be set in the longitudinal direction of the loading bed 56 by teaching. The target loading point P is set at the central part of the width of the loading bed 56 in a direction orthogonal to each of the longitudinal direction and the vertical direction of the loading bed 56 (in other words, a transverse direction).

The controller 11 controls the loading work based on the set target loading point P. At this time, after the controller 11 rotates the bucket 33 such that the opening surface of the bucket 33 becomes vertical at the target loading point P, the controller 11 drives the boom 31, the arm 32, and the bucket 33 such that the opening surface of the bucket 33 faces downward while maintaining the position, with respect to the machine body 24, of the leading end of the bucket 33 in the front-and-rear direction.

Figure 5:
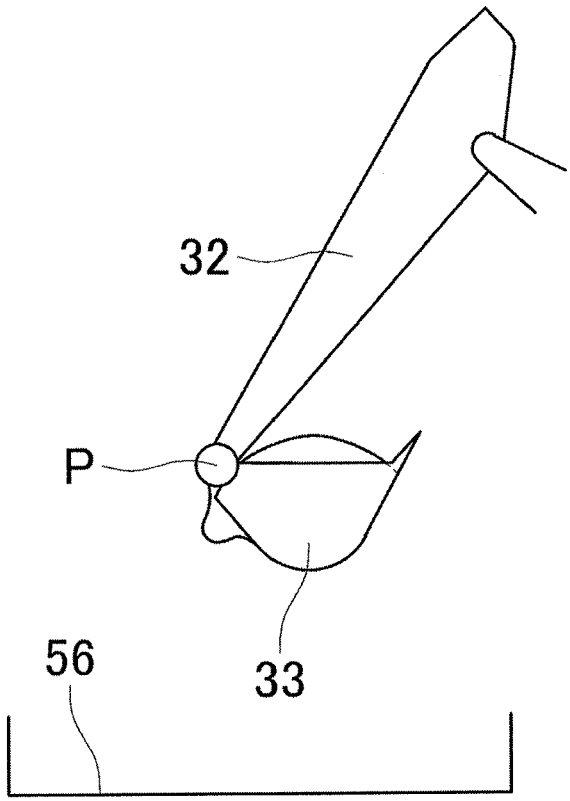
FIG. 5 is a side view of an arm and a bucket, and is a view illustrating a state where soil and sand are held by the bucket.

Specifically, as illustrated in FIGS. 5 to 8, which are side views of the arm 32 and the bucket 33, the boom 31, the arm 32, and the bucket 33 are driven. First, as illustrated in FIG. 5, when the leading end of the arm 32 is disposed at the target loading point P in a state where the bucket 33 holds soil and sand, the controller 11 stops the boom 31, the arm 32, and the bucket 33 in that state. At this time, the opening surface of the bucket 33 is horizontal.

Figure 6:
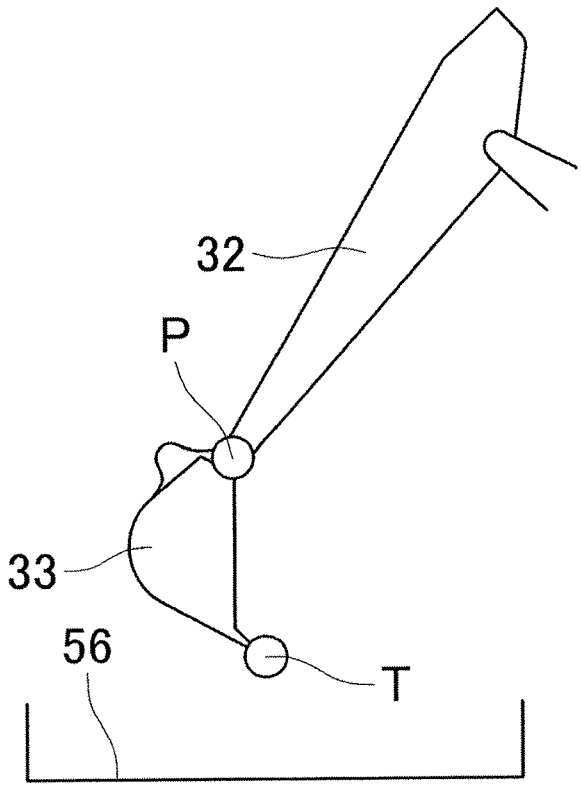
FIG. 6 is a side view of the arm and the bucket, and is a view illustrating a state where an opening surface of the bucket is made vertical.

Next, as illustrated in FIG. 6, the controller 11 rotates the bucket 33 such that the opening surface of the bucket 33 becomes vertical. As a result, a part of the soil and sand held by the bucket 33 falls onto the loading bed 56.

Figure 7:
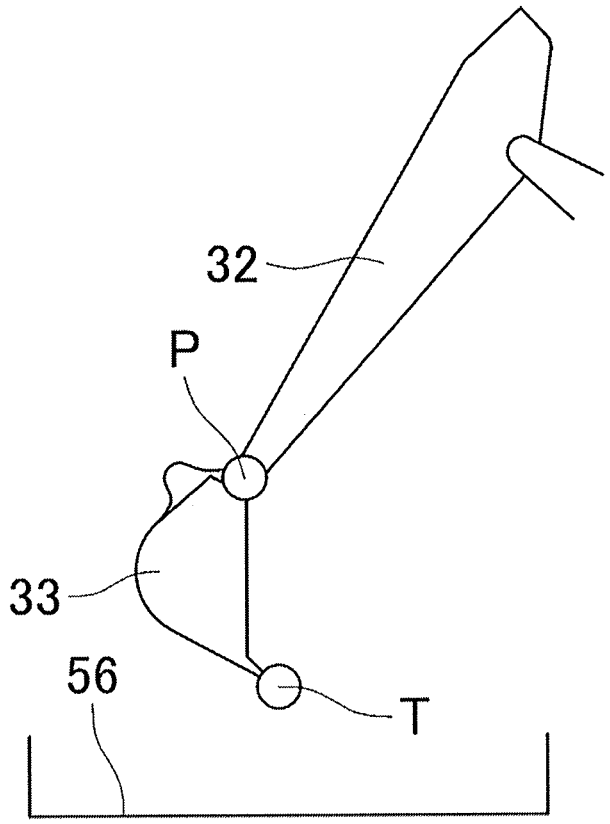
FIG. 7 is a side view of the arm and the bucket, and is a view illustrating a state where the boom, the arm, and the bucket are being driven such that the opening surface of the bucket faces downward.
Figure 8:
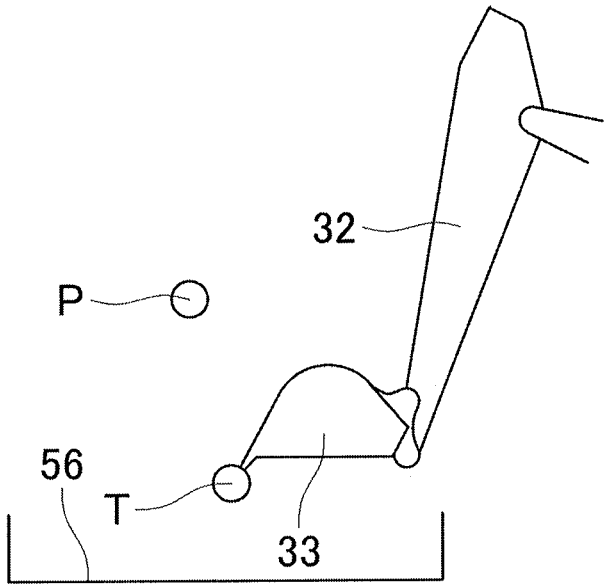
FIG. 8 is a side view of the arm and the bucket, and is a view illustrating a state where the opening surface of the bucket faces downward.

Next, as illustrated in FIGS. 7 and 8, the controller 11 drives the boom 31, the arm 32, and the bucket 33 such that the opening surface of the bucket 33 faces downward while maintaining a position T, with respect to the machine body 24, of the leading end of the bucket 33 in the front-and-rear direction. Specifically, the boom 31 rotates and, at the same time, the arm 32 moves toward the upper slewing body 22 (an arm pulling operation is performed), so that the opening surface of the bucket 33 faces downward. With the rotation of the boom 31, soil and sand in the bucket 33 fall onto the loading bed 56.

As a result, as illustrated in FIG. 8, the opening surface of the bucket 33 is directed downward, and almost all of the soil and sand held by the bucket 33 falls onto the loading bed 56.

In the present embodiment, by directing the opening surface of the bucket 33 downward while maintaining the position T of the leading end of the bucket 33 with respect to the machine body 24, the position at which the soil and sand are discharged can be kept substantially the same from the initial stage to the late stage of the rotation of the bucket 33. As a result, soil and sand can be loaded onto the fixed point of the loading bed 56.

In addition, by performing the operation of discharging soil and sand at the target loading point P set at the central part of the loading bed 56 in the transverse direction of the loading bed 56, it is possible to suppress soil and sand from spilling from the loading bed 56.

On the other hand, it can be considered to drive the boom 31, the arm 32, and the bucket 33 so as to maintain the position T of the leading end of the bucket 33 from the state where the opening surface of the bucket 33 is horizontal (the state illustrated in FIG. 5) to the state where the opening surface of the bucket 33 faces downward (the state illustrated in FIG. 8). However, in this case, because the leading end of the bucket 33 is closer to the upper slewing body 22 than the leading end of the arm 32 is, there is a possibility that, when the bucket 33 is rotated, the bucket 33 protrudes from the loading bed 56 in the region between the upper slewing body 22 and the loading bed 56 in plan view and soil and sand spill outside the loading bed 56. To address this issue, it can be considered to position the leading end of the bucket 33 at the target loading point P so that the bucket 33 does not protrude from the loading bed 56. However, in this case, there is a possibility that the leading end of the arm 32 is too distant from the upper slewing body 22 that the opening surface of the bucket 33 cannot be maintained to be horizontal due to the structure of the attachment 30.

In the present embodiment, the following operation makes it possible to maintain the opening surface of the bucket 33 to be horizontal and to prevent the bucket 33 from protruding from the loading bed 56. The leading end of the arm 32 is positioned at the target loading point P in the state where the opening surface of the bucket 33 is horizontal, and after the opening surface of the bucket 33 is made vertical, the bucket 33 is rotated while maintaining the position T of the leading end of the bucket 33 with respect to the machine body 24.

Advantageous Effects

As described above, in the work machine 1 according to the present embodiment, after the bucket 33 is rotated such that the opening surface of the bucket 33 becomes vertical at the target loading point P, the boom 31, the arm 32, and the bucket 33 are driven such that the opening surface of the bucket 33 faces downward while the position T, with respect to the machine body 24, of the leading end of the bucket 33 in the front-and-rear direction is maintained. By directing the opening surface of the bucket 33 downward while maintaining the position of the leading end of the bucket 33 with respect to the machine body 24, the position where the soil and sand are discharged can be kept substantially the same from the initial stage to the late stage of the rotation of the bucket 33. As a result, soil and sand can be loaded onto the fixed point of the loading bed 56.

In addition, the target loading point P is set at the central part of the loading bed 56 in the direction orthogonal to each of the longitudinal direction and the vertical direction of the loading bed 56. By performing the operation of discharging soil and sand at such a target loading point P, it is possible to suppress soil and sand from spilling from the loading bed 56.

Although the embodiment of the present invention has been described above, only a specific example has been described, and the present invention is not particularly limited to the embodiment; therefore, a specific configuration and the like can be modified in design as appropriate. In addition, the actions and effects described in the embodiment of the present invention merely recite the most suitable actions and effects resulting from the present invention, and the actions and effects according to the present invention are not limited to those described in the embodiment of the present invention.

The invention claimed is:

1. A work machine comprising:

a machine body;

a boom attached to the machine body to be rotatable in an up-and-down direction;

an arm attached to the boom to be rotatable in the up-and-down direction;

a bucket attached to the arm to be rotatable in a front-and-rear direction; and a controller that causes the boom, the arm, and the bucket to automatically perform an operation of discharging a transport object held by the bucket by driving the boom, the arm, and the bucket, based on a target loading point set above a loading target, wherein after the controller causes the bucket to rotate such that an opening surface of the bucket becomes vertical at the target loading point, the controller drives the boom, the arm, and the bucket such that the opening surface of the bucket faces downward while maintaining a position, with respect to the machine body, of a leading end of the bucket in the front-and-rear direction and the up-and-down direction.

2. The work machine according to claim 1, wherein the target loading point is set at a central part of the loading target in a direction orthogonal to each of a longitudinal direction and a vertical direction of the loading target.

* * * * *